US010407216B1

(12) United States Patent
Glass et al.

(10) Patent No.: US 10,407,216 B1
(45) Date of Patent: Sep. 10, 2019

(54) AUDIO GIFT BAG WITH HANDLES

(75) Inventors: Brett R. Glass, Overland Park, KS (US); Nicole E. Glass, Overland Park, KS (US)

(73) Assignee: Gift Card Impressions, LLC, Kansas City, MO (US)

( * ) Notice: Subject to any disclaimer, the term of this patent is extended or adjusted under 35 U.S.C. 154(b) by 0 days.

(21) Appl. No.: 13/013,785

(22) Filed: Jan. 25, 2011

Related U.S. Application Data

(60) Provisional application No. 61/298,013, filed on Jan. 25, 2010.

(51) Int. Cl.
*B65D 33/00* (2006.01)
*B65D 33/12* (2006.01)
*B42D 15/02* (2006.01)

(52) U.S. Cl.
CPC ..... *B65D 33/00* (2013.01); *B42D 15/022* (2013.01); *B65D 33/004* (2013.01); *B65D 33/12* (2013.01)

(58) Field of Classification Search
CPC ..... B65D 33/16; B65D 33/12; B65D 33/24; B65D 33/243; B65D 33/246; B65D 33/28; B65D 3/20; B65D 5/6602; B65D 5/6611; B65D 5/6623; B65D 5/6626; B65D 5/6655; B65D 5/6661; B65D 5/0254; B65D 51/248; B65D 2251/01; A45C 3/04; B42D 15/002
USPC ..... 383/26, 71, 72, 76, 77, 78, 81, 84, 86, 383/86.1, 27, 86.2, 29–31, 92, 79; 40/124.03, 455, 906; 340/568.7; 206/242, 260, 261, 263, 268, 428, 4, 28, 206/434, 435; 229/87.19, 116.1, 116.5, 229/125.08, 126, 141, 67.1, 67.4, 89–91, 229/128, 130, 131
See application file for complete search history.

(56) References Cited

U.S. PATENT DOCUMENTS

| | | | | | |
|---|---|---|---|---|---|
| 271,974 | A | * | 2/1883 | De Quillfeldt | 150/110 |
| 276,961 | A | * | 5/1883 | De Quillfeldt | 150/112 |
| 308,418 | A | * | 11/1884 | Lockwood | 383/26 |
| 708,234 | A | * | 9/1902 | Laird | 383/26 |
| 1,668,572 | A | * | 5/1928 | Parmele | 206/292 |
| 1,984,150 | A | * | 12/1934 | Ottinger | 383/86 |
| 2,059,382 | A | * | 11/1936 | Maten et al. | 206/273 |
| 2,326,683 | A | * | 8/1943 | Ross | 206/0.815 |
| 2,385,576 | A | * | 9/1945 | Israel | 229/77 |
| 2,413,465 | A | * | 12/1946 | Ohlsen | A45C 3/06 132/314 |
| 2,445,001 | A | * | 7/1948 | Pence | 206/268 |
| D247,392 | S | | 2/1978 | Coleman | |
| 4,243,171 | A | * | 1/1981 | Prin | 229/117.16 |
| D305,728 | S | * | 1/1990 | Tufariello | D3/241 |
| 4,955,981 | A | | 9/1990 | Provst | |
| 4,988,216 | A | | 1/1991 | Lyman | |
| 5,044,773 | A | * | 9/1991 | Harms et al. | 383/22 |
| 5,182,895 | A | * | 2/1993 | Lugo | 53/469 |

(Continued)

FOREIGN PATENT DOCUMENTS

| | | |
|---|---|---|
| CN | 2707669 | 7/2005 |
| CN | 2707669 Y | 7/2005 |
| EP | 1669301 | 6/2006 |

*Primary Examiner* — Jes F Pascua
*Assistant Examiner* — Nina K Attel
(74) *Attorney, Agent, or Firm* — Erise IP, P.A.

(57) ABSTRACT

A bag having a flap-activated audio or sound player and handles to cinch the flap securely in a closed position to avoid inadvertent activation of the sound player.

18 Claims, 8 Drawing Sheets

(56) References Cited

U.S. PATENT DOCUMENTS

D343,288 S * 1/1994 Chao ..... D3/290
D350,689 S * 9/1994 Chao ..... D9/704
5,374,232 A 12/1994 Cipollone
5,542,634 A * 8/1996 Pomerantz ..... 248/214
5,577,918 A * 11/1996 Crowell ..... B42D 15/022 150/147
5,778,574 A * 7/1998 Reuben ..... G09F 3/14 40/124.03
5,795,209 A 8/1998 Moore
D407,209 S 3/1999 Brown et al.
D409,450 S 5/1999 Hamilton
5,957,354 A 9/1999 Mentken
5,988,879 A 11/1999 Bredderman et al.
6,137,410 A 10/2000 Sepulveda
6,158,588 A * 12/2000 Conti ..... B65D 5/4291 116/307
6,230,950 B1 5/2001 Heetman
6,273,332 B1 * 8/2001 Todjar-Hengami ..... B65D 5/4291 229/117.28
6,380,856 B1 4/2002 Johnson et al.
6,737,959 B2 5/2004 Ho
D493,829 S 8/2004 Foster
6,864,791 B1 3/2005 Kam
7,219,814 B2 5/2007 Lown et al.
D547,673 S 7/2007 Glass
D548,107 S 8/2007 Glass
D555,008 S 11/2007 Gattino
D555,352 S 11/2007 Lown
7,312,717 B2 12/2007 Schmidt-Troschke
D576,500 S 9/2008 Kim et al.
7,467,729 B2 12/2008 Lown et al.
2004/0028296 A1 2/2004 Meli
2005/0098615 A1 * 5/2005 Lockhart ..... 229/67.3
2006/0042135 A1 * 3/2006 Hermanson et al. ..... 40/124.03
2007/0071366 A1 3/2007 Kao
2007/0235506 A1 * 10/2007 Shapiro ..... B42F 7/08 229/67.3
2009/0314668 A1 * 12/2009 Miller ..... B42D 15/022 206/223
2009/0317021 A1 * 12/2009 Taylor ..... 383/6
2010/0089985 A1 * 4/2010 Fusaro ..... 229/68.1
2011/0069910 A1 3/2011 La Riviere

* cited by examiner

Note: sound unit is mounted in back wall below tongue 1
24
26
30
18
A
28
32
20
22
22
20
32
2
11
12
10
16
C
A'
B
B
15
14

Without the improvements of the present invention, the force exerted by the bottle may tend to pop the sides out, deflect the flap upward or cause it to detach from the front panel, and cause the switch to prematurely activate the sound circuit

AUDIO GIFT BAG WITH HANDLES

CROSS REFERENCE TO RELATED APPLICATIONS

This application claims the benefit of the prior filed, provisional application Ser. No. 61/298,013, filed Jan. 25, 2010.

BACKGROUND OF THE INVENTION

This invention relates generally to gift bags and more particularly to a bag for holding an item such as a bottle containing wine or distilled spirits, and still more particularly to a bag with a flap-activated audio or sound player and handles to cinch the flap securely in a closed position to avoid inadvertent activation of the sound player.

BRIEF DESCRIPTION OF THE INVENTION

The purpose of this invention is to provide a gift bag for holding wine or distilled spirits and includes a flap held closed by hook and loop (for example hook and loop fasteners provided under the mark Velcro®) or other means that when opened activates a sound circuit that plays a prerecorded sound, typically music or a greeting of some sort. A handle is looped through a front panel, bellows-folded side panels and a back panel. When the gift bag is carried by the handle, the handle cinches the top of the gift bag together. This means of self-closure is most efficacious when the bag is loaded with a weighted item such as a bottle of wine, distilled spirits or other gift item to be held within the bag. Alternative embodiments may include a record button for purchasers to record a custom message. More typically, the sound will be prerecorded.

The sound circuit is typically activated by a sliding tongue mechanism. The tongue can be a strip of plastic, heavy paper or other suitable material. One end of the tongue is attached to the flap proximate a fold line dividing the flap from the back panel. The other end of the tongue is attached to a switch mechanism on the sound circuit. As the flap is raised the tongue is pulled upward, the switch is actuated to an on position and the sound circuit is activated. As the flap is lowered, the tongue is pushed downward, the switch is actuated to an off position and the sound circuit is deactivated. This type of switch mechanism is well known in the prior art and often used, for example, on greeting cards that provide sound upon opening. A sound recorder and associated audio playback mechanism may be similarly incorporated into the sound circuit.

The gift bag is specifically designed to provide a gift package for generally elongated bottles, in particular wine bottles or bottles containing distilled spirits, or other similar types of bottles that include a neck portion that narrows from the main body of the bottle as it approaches the lip. The T-shaped flap, including upper shoulder portions and a relatively narrow lower portion, cooperates with the bag handles to retain the flap in a closed position and prevent the sound circuit from unintentional or inadvertent activation. This novel flap allows the lower portion of the flap to fit between the bag handles or handle straps, yet provides transverse shoulder portions that extend above the proximate handle grommets. This positioning causes the straps to press against the shoulders, and thereby hold the flap against the main body of the bag, when the handles are pulled and tightened—particularly when the bag is carried by holding the handle straps and with a relatively heavy object inside and supported by the bag, such as a bottle of wine, distilled spirits, or other liquid, or any other gift or object that may be placed and held within the bag. A secondary fold in the flap provides additional room in the upper portion of the bag to accept the upper neck of a bottle and also relieves stress on the flap.

In an embodiment of the present invention a bag may include a main body including a front panel and a back panel joined to one another at the sides by a left side panel and a right side panel extending between the front panel and the back panel, the front panel, back panel and side panels joined to one another at the bottom of the main body by a base panel. The main body presents an opening at the top and the bottom of the main body is closed by the base panel. A flap projects from the top edge of the back panel and is sized to extend to the front panel to cover the opening when the flap is in a closed position. The flap includes shoulder portions on either side thereof extending over the front panel when the flap is in a closed position. The side panels include creases to form gussets such that the side panels may fold inward. A flexible handle threaded through apertures in the front panel, side panels and back panel draws these elements inward when pulled or tightened to cinch the bag to a closed disposition. Portions of the handle are disposed to abut and press against the shoulders when the handle is tightened and the bag is in a closed disposition.

Other advantages of the invention will become apparent from the following description taken in connection with the accompanying drawings, wherein is set forth by way of illustration and example an embodiment of the present invention.

DETAILED DESCRIPTION

Figure 1:
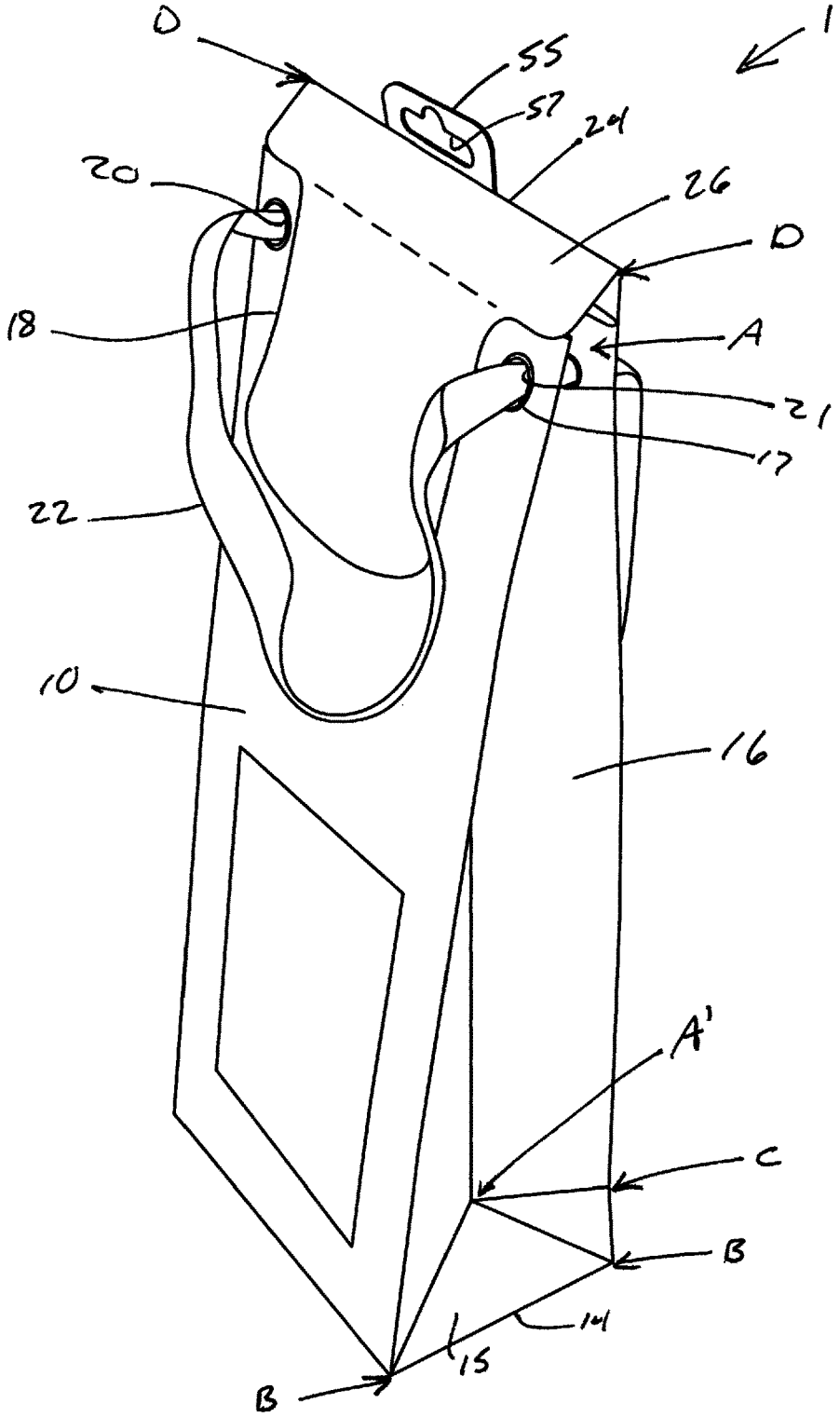
FIG. 1 is a perspective view of the gift bag.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring now to FIGS. 1 through 6, there is shown an embodiment of a gift bag of the present invention indicated generally by the reference numeral 1.

Figure 2:
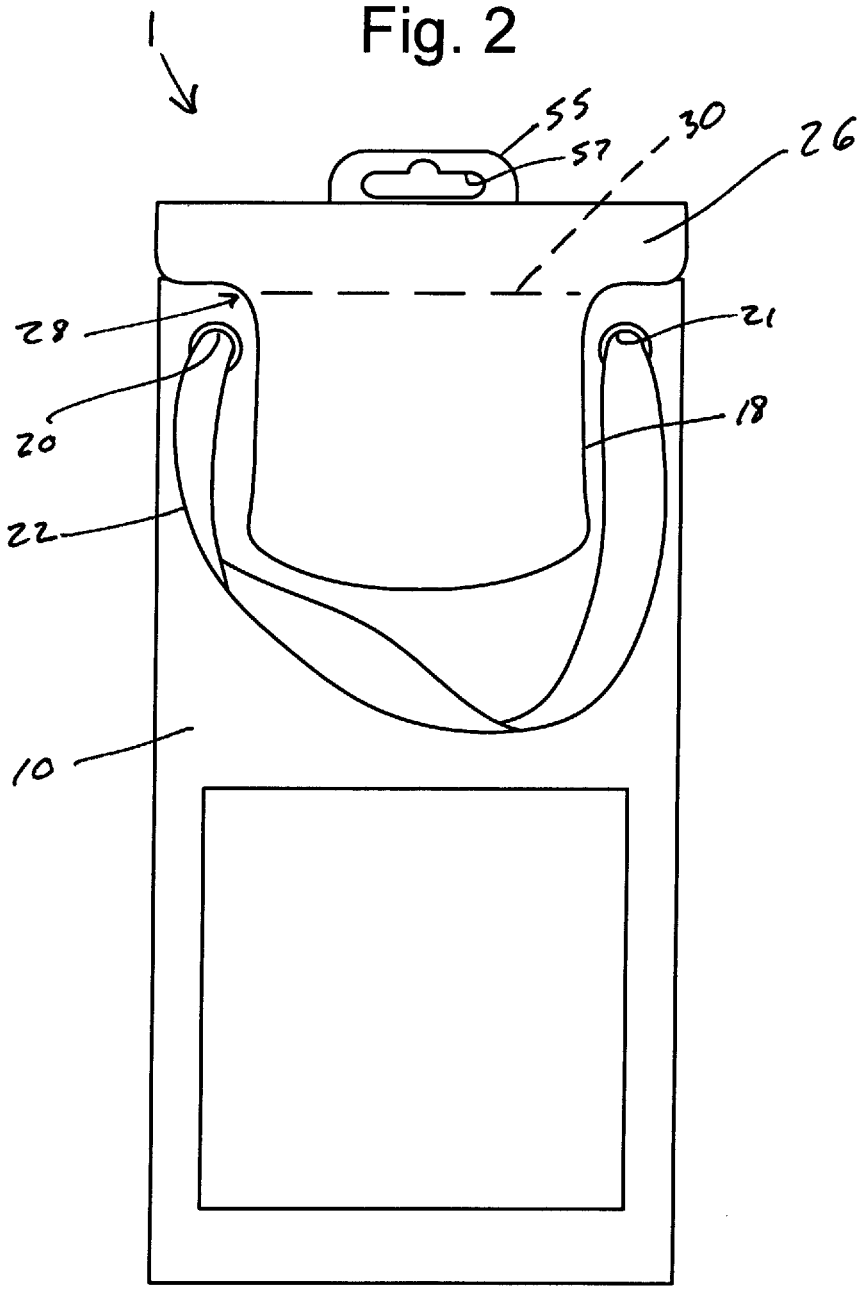
FIG. 2 is a front view of the gift bag.
Figure 3:
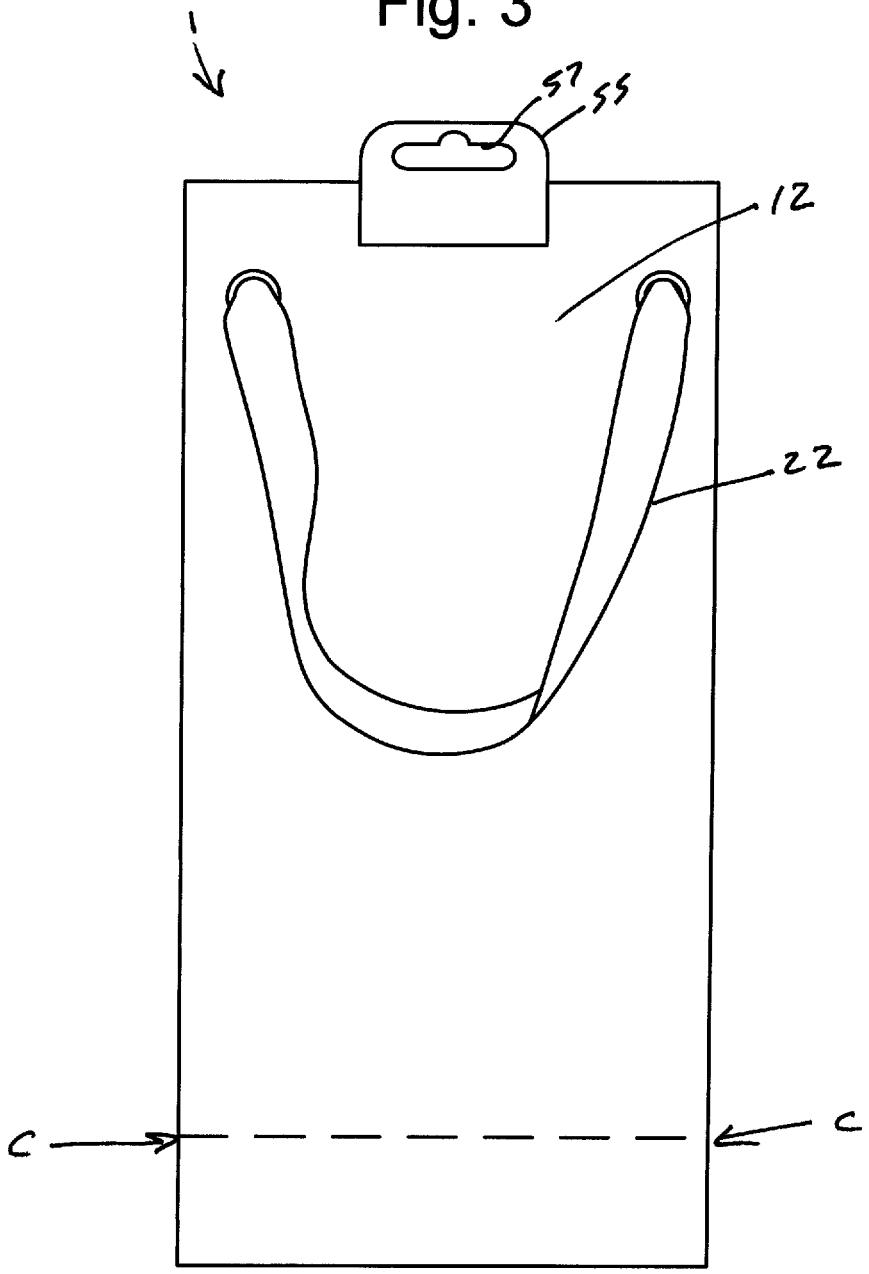
FIG. 3 is a back view of the gift bag.
Figure 4:
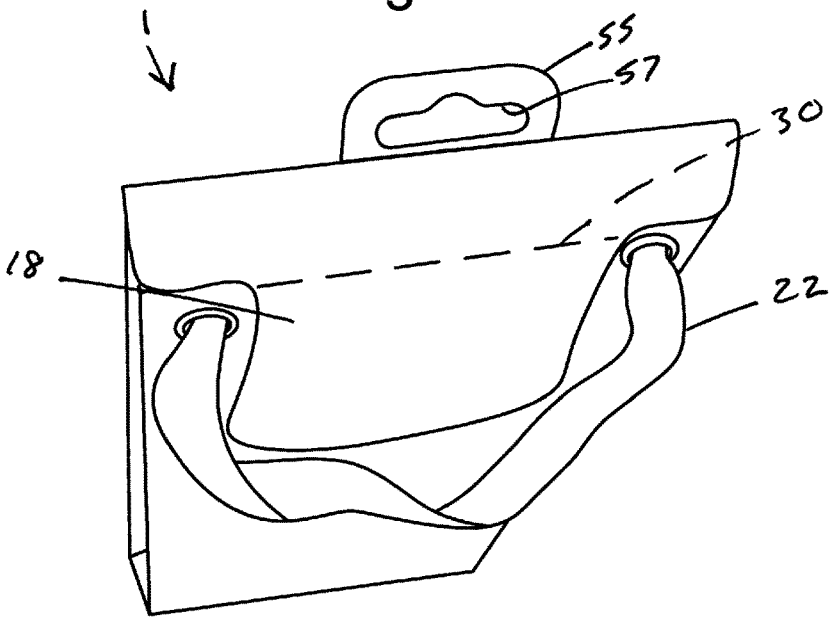
FIG. 4 is a top view of the gift bag.

Referring now to FIGS. 1, 2 and 3 there is shown a gift bag 1 which may embody certain elements of the present invention. The gift bag 1 comprises a generally rectangular front panel 10, a generally rectangular back panel 12, a generally rectangular base panel 14 and side panels 16 that are generally rectangular when in an unfolded position. The front panel 10 and side panels 16 are substantially the same height. The back panel 12 is slightly taller than the front panel 10 and side panels 16. The side panels 16 are folded longitudinally inwardly in a bellows or pleated fold A-A'. The front panel 10, back panel 12, side panels 16 and base panel 14 comprise a main body 2 of the gift bag 1.

A top edge 24 of a T-shaped cover flap 18 is hingedly connected to the top, free edge of the back panel 12. Preferably, a fold along line D-D provides the hinge connection between the back panel 12 and top edge 24 of the T-shaped cover flap 18 so that the flap 18 may be integral with the back panel 12. The front panel 10, back panel 12, base panel 14 and side panels 16 may comprise cardboard, heavy paper, plastic, resilient polymer foam, or any other sufficiently resilient material. In certain embodiments the material comprises approximately 250 gsm laminated card stock or materials of comparable strength, durability, and/or stiffness. The material or materials selected for fabrication of the bag 1 are preferably of at least sufficient strength to bear the weight of a 750 mL bottle of wine, distilled spirits, or other liquid and more preferably are of at least sufficient strength to bear the weight of a 1.5 mL bottle of wine, distilled spirits, or other liquid.

When the bag 1 is placed in a typical upright position, the side panels are folded or creased along lines A'-B to form gussets 15 such that the gift bag 1 rests upon the base 14 in a substantially upright and unfolded position. In a folded position, the side panels are additionally folded along lines A'-C and the back panel 12 is folded along line C-C so that the base panel 14 may be folded inwardly towards the back panel 12 such that the gift bag 1 may lie in a substantially flat and folded position.

First side handle holes 20 and second side handle holes 21 are provided through the front panel 10, back panel 12, and side panels 16. The front panel 10 comprises a first side handle hole 20 and second side handle hole 21, each side panel comprises two first side handle holes 20 or second side handle holes 21, and the back panel comprises a first side handle hole 20 and second side handle hole 21. When the gift bag 1 is in a substantially flat and folded position, the first handle holes 20 in the front panel 10, back panel 12, and side panels 16 are substantially aligned with one another. Similarly, the second handle holes 21 in the front panel 10, back panel 12, and side panels 16 are also substantially aligned with one another when the bag 1 is in a substantially flat and folded position. The handle holes 20 and 21 may be reinforced by grommets 17 or other reinforcement means to enhance the ability of the bag 1 to hold heavy objects without the handle 22 or handles straps tearing through the bag structure.

The handle 22 is preferably made from cloth, vinyl, plastic, leather or other flexible or pliable material, and is threaded through the first side handle holes 20 and then the second side handle holes 21. The ends of the handle 22 are connected together to form a continuous loop. When the gift bag 1 is carried by the handle 22, the handle 22 acts to cinch the gift bag shut wherein the upper ends of the front panel 10 and back panel 12 are pulled together by folding the bellows folded side panels 16. This cinching action is enhanced when the bag 1 is loaded with a weighted item such as a bottle of wine, distilled spirits, or other liquid, or other appropriately sized gift item.

Figure 5:
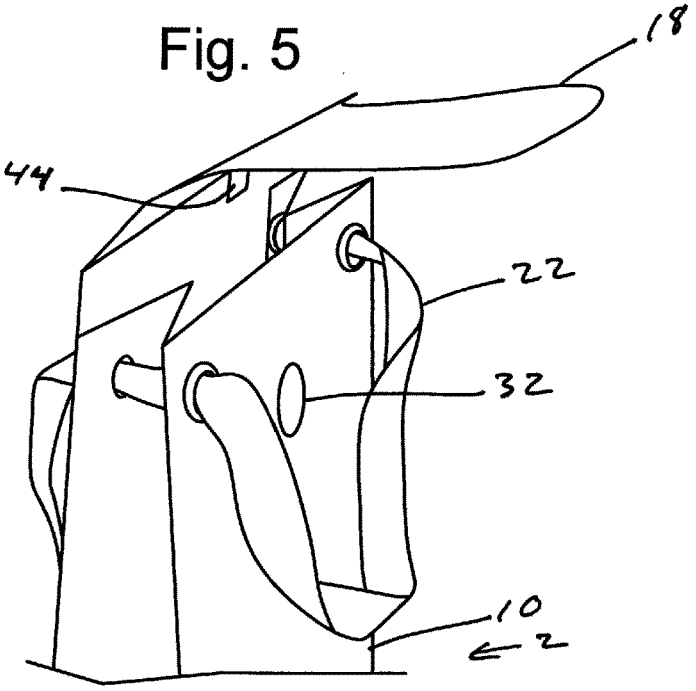
FIG. 5 is a perspective view of the gift bag showing the flap in an intermediate open position, the hook and loop closing means, sliding tongue mechanism and handle.
Figure 6:
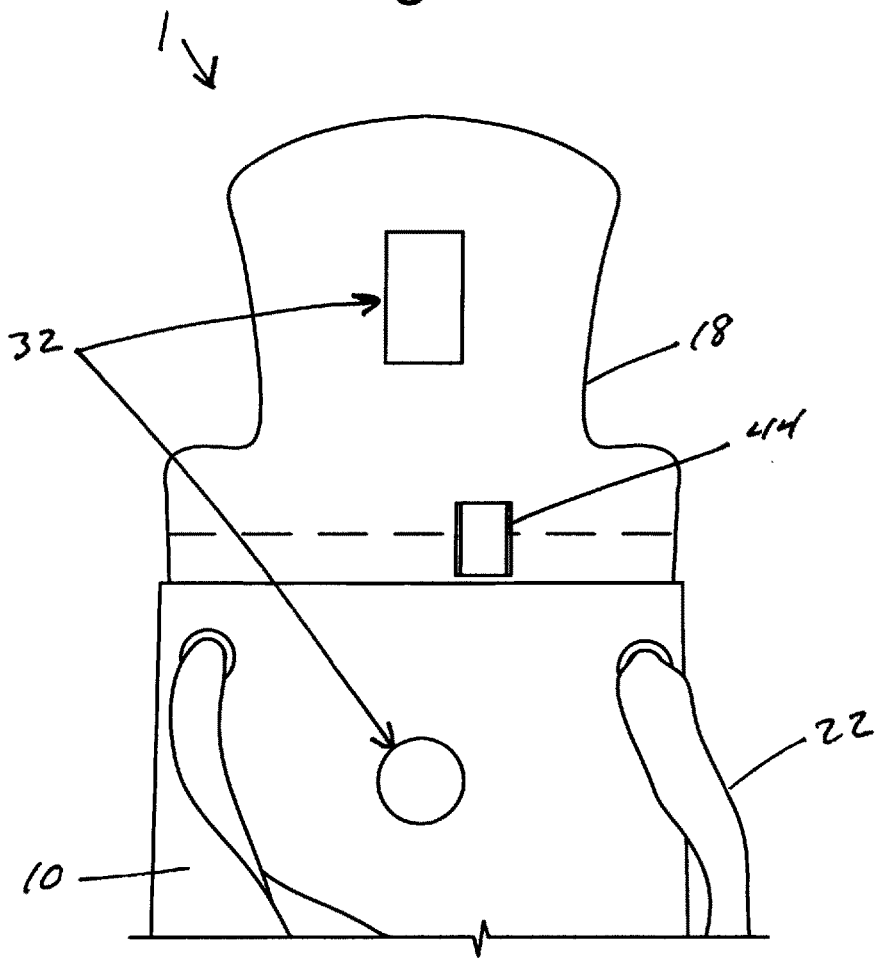
FIG. 6 is a front view of the gift bag showing the flap in a fully open position, the hook and loop closing means, sliding tongue mechanism and handle.

The hingedly connected T-shaped cover flap 18 can be moved from an open position, shown in FIGS. 5 and 6 to a closed position, shown in FIGS. 1-4. In the closed position, the upper end of the bellows folded side panels 16 fold along A-A to bring the top edges of the front panel 10 and back panel 12 closer together. In the closed position, the shoulders 26 of the cross-portion of the T-shaped cover flap 18 extend below the top edge of the front panel 10 to substantially cover the gift bag 1 opening 19. The neck 28 of the cover flap 18 is reduced so as to avoid covering the side handle holes 20 and 21.

Now referring to FIGS. 5 and 6, the cover flap 18 is provided with a means for latching 32 the cover flap 18 to the front panel 10. In a preferred embodiment, a hook and loop means 32 for latching is attached to the inner surface of the cover flap 18 and also to the respective outer surface of the front panel 10 that lies against the inner surface when the flap 18 is in the closed position.

The cover flap 18 further includes a neck fold 30 or crease that may lie substantially along, or slightly offset from, the reduced neck 28. When the cover flap 18 is in the closed position, the cover flap 18 will preferentially bend at the neck fold 30. Upon a force pulling or pushing the upper ends of the front panel 10 and back panel 12 apart and therefore expanding the bellows fold A-A, the preferential bend at the neck fold 30 allows the front panel 10 and back panel 12 to part before the latching means 32 is forced to unlatch.

A sound emitting device 40 is located within the back panel 12 of the gift bag 1. The sound emitting device 40 includes an electronic microchip sound emitting device 42 that includes a switch means 46 connected at one end to a slidable tongue mechanism 44 that is attached at the other end to the cover flap 18. Upon opening the cover flap 18, the slidable tongue mechanism 44 is pulled upward and allows the switch means 46 to close thereby activating the sound emitting device 40. Conversely, closing the cover flap 18 forces the slidable tongue mechanism 44 downward to open the switch means 46 and thereby deactivating the sound emitting device 40.

In order to hang the gift bag 1 for display purposes, a hang tag 55 or other means for hanging, such as a loop of textile, paper or plastic, may be attached to the top end of the back panel 12. The hang tag 55 may comprise a sombrero cut aperture 57 for hanging the gift bag 1 upon a display stand peg such as a typical J-hook peg (not shown).

Figure 7:
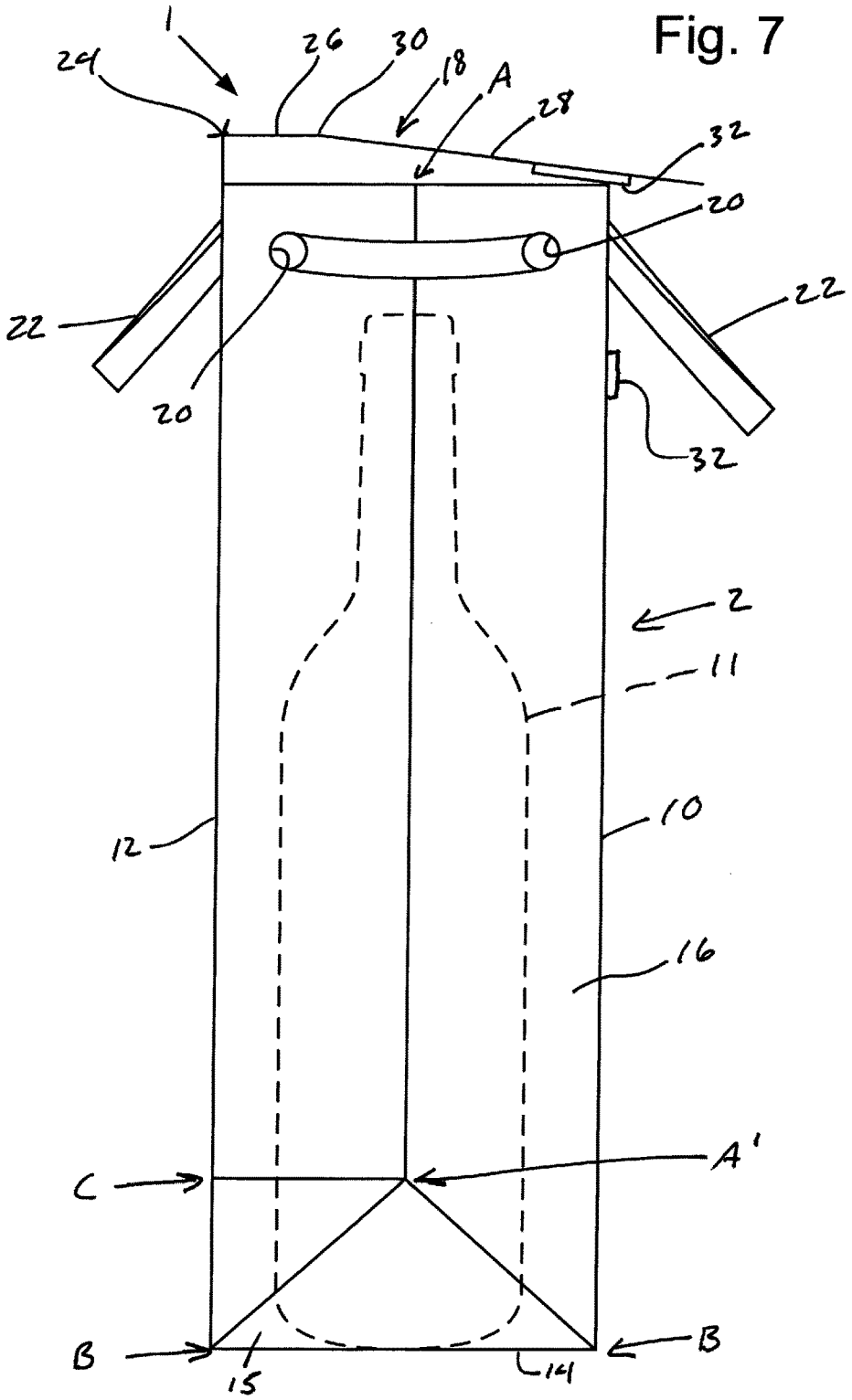
FIG. 7 is a side view of a gift bag with the main body in a substantially open position and a bottle held therein shown in phantom lines.

FIG. 7 is a side view of the gift bag 1 showing the main body 2 in a substantially open position and folds A-A', A'-C and A'-B substantially unfolded. A bottle 11 (drawn in phantom lines) is shown held within bag 1. It should be appreciated that bottles or other items of varying dimensions may be held within the bag 1.

Figure 8:
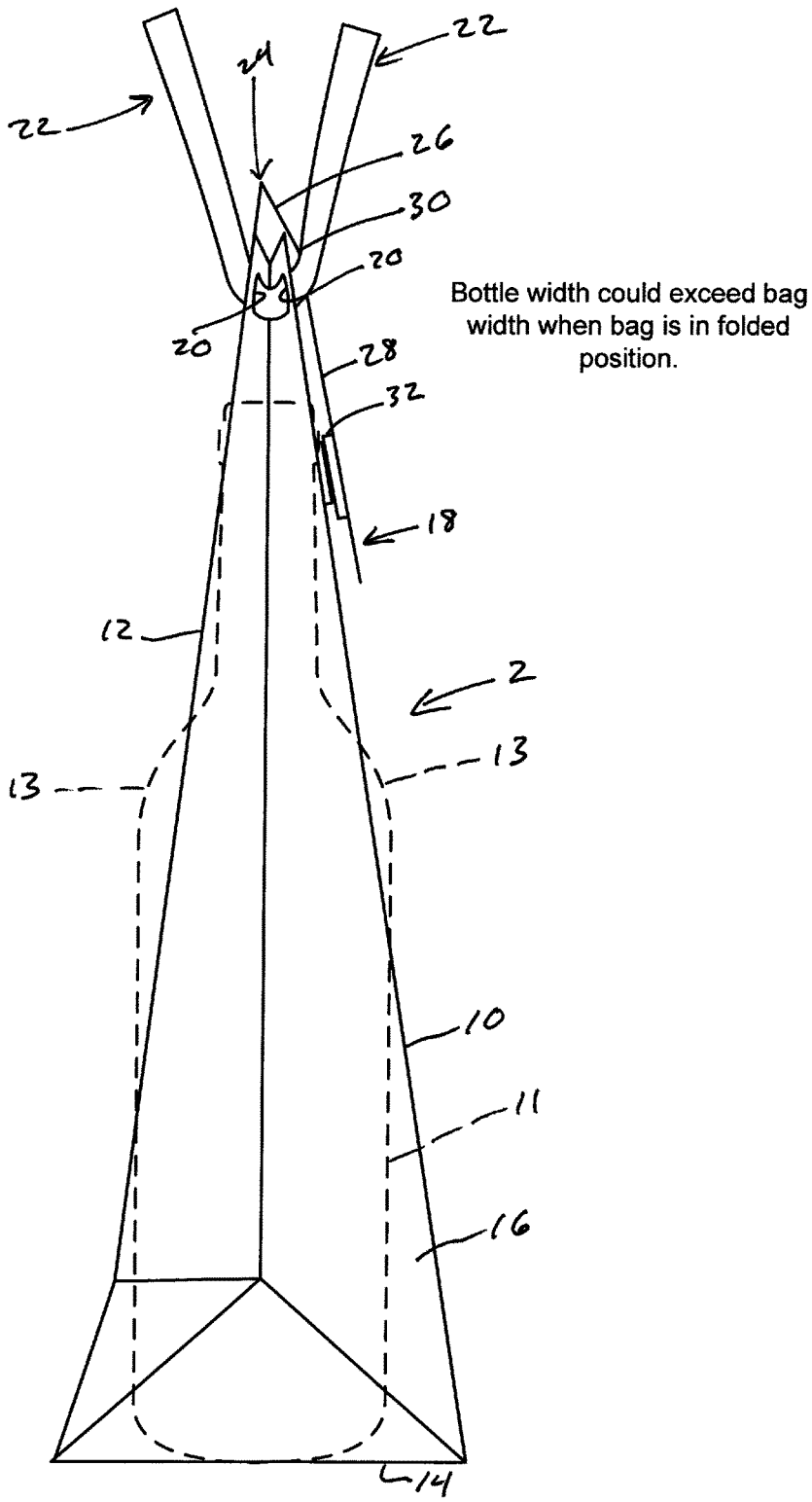
FIG. 8 is a side view of a gift bag with the flap fully closed, and an outline of a bottle superimposed thereon in phantom lines, to indicate that the contours of a typical bottle may extend outside the typical margins of an empty, closed gift bag.

FIG. 8 is a side view of the gift bag 1 with the flap 18 fully closed and an outline of a bottle 11 superimposed thereon in phantom lines to indicate that the contours of a typical bottle 11, particularly the bottle shoulders 13, may extend outside the typical margins a closed bag 1 will likely assume when it is empty, i.e. when the front, back and side panels (10, 12 and 16, respectively) assume their normal shapes and configurations without interference from an item held within the bag 1.

Figure 9:
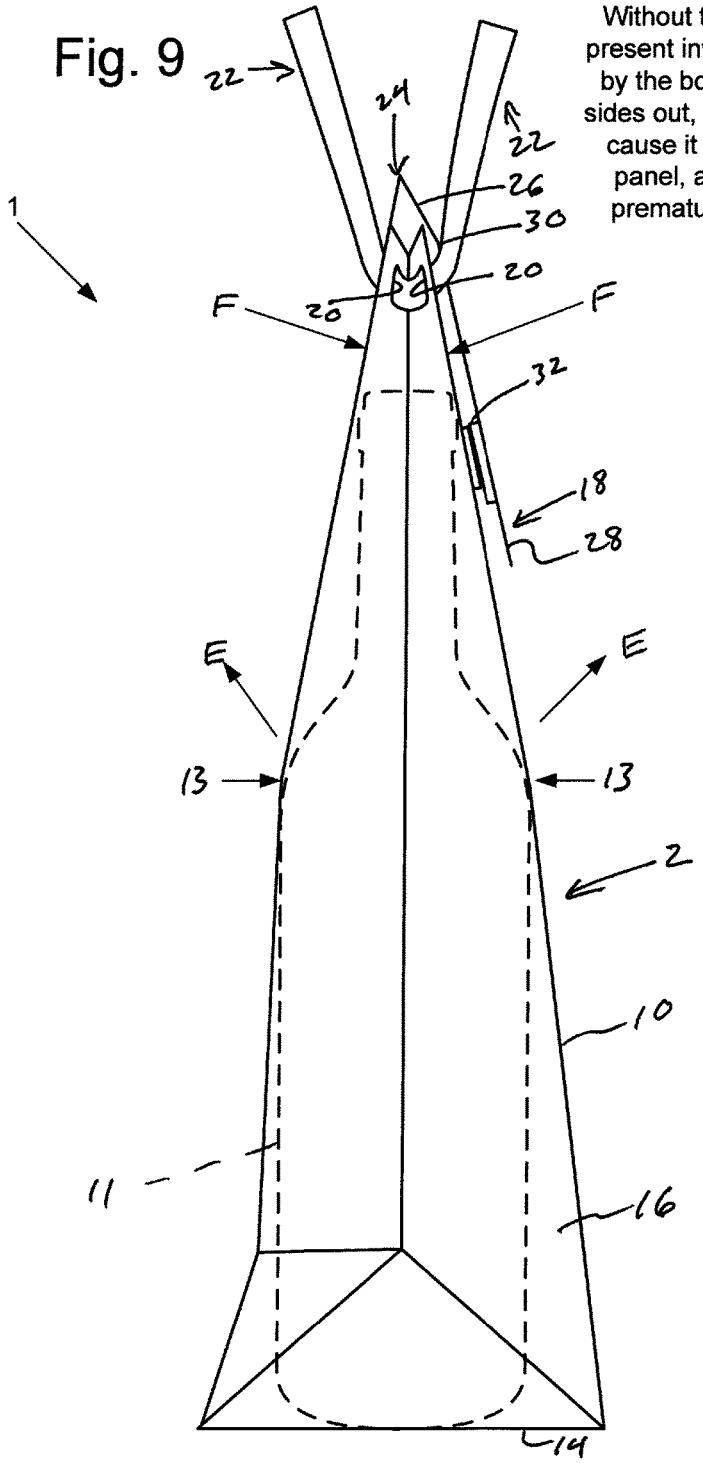
FIG. 9 is a side view of a gift bag with the flap fully closed and a bottle held therein shown in phantom lines to indicate that the contours of the bottle outwardly deform the front and back panels of the bag.

FIG. 9 is a side view of the gift bag 1 with the flap 18 fully closed and a bottle 11 held therein shown in phantom lines to indicate that the typical contours of the bottle 11 may outwardly deform the front 10 and back 12 panels of the bag 1, thereby creating forces (see arrows E) that might tend to overcome the strength of the means for latching 32 the bag 1 without the mitigating opposing forces (see arrows F) created by the cinching action of the handle 22 and the pressure of the handle 22 against the flap shoulders 26.

Having thus described the invention, what is claimed as new and desired to be secured by Letters Patent is:

1. A bag comprising:

a main body including a front panel, a back panel, a left side panel, a right side panel, and a base panel, wherein the main body presents an opening at a top end;

a flap disposed on the back panel at the top end, wherein the flap includes an elongated neck and a shoulder portion, wherein the flap presents a top edge and a neck fold, wherein the flap bends at the neck fold when in a closed position, wherein the neck fold lies substantially along or slightly offset from the elongated neck, wherein the bag is configured to be selectively placed into an open position, a first closed position, and a second closed position, wherein the first closed position is defined as the front panel, the back panel, and the flap being substantially parallel to each other, with the flap covering the opening, wherein the second closed position is defined as the front panel and the back panel being disposed at an acute angle so as to accommodate an object within the bag, with the flap covering the opening;

a looped handle disposed at least partially through the front panel and the back panel and configured to cinch the top end of the bag into the second closed position, wherein the looped handle is configured to keep the flap adjacent to the front panel in the second closed position, a sound device secured to the main body having a switch secured to the flap, wherein the flap is configured to activate the switch while the bag is in the open position and deactivate the switch while the bag is in the first closed position and the second closed position, wherein the neck fold allows separation between the front panel and the back panel by creating an angle between the elongated neck and the shoulder portion such that the front panel and the back panel are separated to allow the object to be disposed in the bag without activating the switch that is secured to the flap so as to prevent inadvertent playing of the sound device.

2. The bag of claim 1, wherein the bag is further configured to be disposed in a third closed position defined as the front panel and the back panel being deflected inward, wherein the flap is configured to deactivate the switch in the third closed position.

3. The bag of claim 2, wherein the neck fold in the flap allows the front panel and the back panel to separate, in the third closed position, in order to contain the object within the bag while not forcing the elongated neck to unlatch from the front panel.

4. The bag of claim 2, wherein the flap deactivates the sound device in the third closed position.

5. The bag of claim 1, wherein the front panel and the back panel each present an aperture, wherein said looped handle is threaded through the apertures in the front panel and the back panel to draw the front panel to the back panel inward to cinch the bag in the second closed position.

6. The bag of claim 5, wherein the left side panel and the right side panel each present a side aperture, wherein said looped handle is threaded through the apertures and the side apertures.

7. The bag of claim 1, further comprising:

a reusable fastener configured to retain the flap adjacent to the front panel, wherein the reusable fastener is formed of a hook-and-loop fastener.

8. The bag of claim 1, wherein the sound device comprises:

an electronic microchip; and a memory for storing a prerecorded message.

9. The bag of claim 8, wherein the sound device further comprises a record button configured instruct the electronic microchip to record a customized message to be said prerecorded message.

10. The bag of claim 1, wherein the right side panel and the left side panel each includes a crease that form gussets when bag is in the first closed position.

11. A bag comprising:

a main body including a front panel, a back panel, a left side panel, a right side panel, and a base panel, wherein the main body presents an opening at a top end;

a T-shaped flap disposed on the back panel at the top end, wherein the T-shaped flap includes an elongated neck and a shoulder portion, wherein the flap presents a top edge and a neck fold, wherein the flap bends at the neck fold when in a closed position, wherein the neck fold lies substantially along or slightly offset from the elongated neck, wherein the bag is configured to be selectively placed into an open position, a first closed position, and a second closed position, wherein the first closed position is defined as the front panel, the back panel, and the T-shaped flap being substantially parallel with the T-shaped flap covering the opening, wherein the second closed position is defined as the front panel and the back panel being disposed at an acute angle so as to accommodate an object within the bag with the T-shaped flap covering the opening;

a looped handle disposed at least partially through the front panel and the back panel and configured to cinch the top end of the bag into the second closed position, wherein the looped handle is configured to keep the shoulder portion of the T-shaped flap adjacent to the front panel in the second closed position; and a sound device secured to the main body having a switch secured to the T-shaped flap, wherein the T-shaped flap is configured to activate the switch while the bag is in the open position and deactivate the switch while the bag is in the first closed position and the second closed position, wherein the neck fold allows separation between the front panel and the back panel by creating an angle between the elongated neck and the shoulder portion such that the front panel and the back panel are separated to allow the object to be disposed in the bag without activating the switch that is secured to the flap so as to prevent inadvertent playing of the sound device.

12. The bag of claim 11, wherein the bag is further configured to be disposed in a third closed position defined as the front panel and the back panel being deflected inward, wherein the T-shaped flap is configured to deactivate the switch in the third closed position.

13. The bag of claim 12, wherein the looped handle is configured to keep the T-shaped flap adjacent to the front panel when the bag is in the third closed position.

14. The bag of claim 11, wherein the elongated neck of the T-shaped flap is hingedly engaged to the shoulder portion by the neck fold, wherein the neck fold allows the front panel and the back panel to separate, in the third closed position, in order to contain the object within the bag while not forcing the elongated neck to unlatch from the front panel.

15. The bag of claim 11, wherein the T-shaped flap has a length extending away from the top edge of the back panel that is greater than a maximum width of the elongated neck.

16. The bag of claim 11, wherein the looped handle forms a continuous loop, wherein the front panel and the back panel each present an aperture, wherein said looped handle is threaded through the apertures in the front panel and the back panel to draw the front panel to the back panel inward to cinch the bag in the second closed position.

17. The bag of claim 11, wherein at least a portion of the elongated neck of the T-shaped flap is disposed between the apertures when the bag is in the second closed position such that the looped handle is adjacent to the shoulder portion while the bag is being carried.

18. The bag of claim 11, further comprising:

a reusable fastener configured to retain the T-shaped flap adjacent to the front panel, wherein the reusable fastener is formed of a hook-and-loop fastener.

* * * * *